United States Patent [19]

Van Der Wielen

[11] 4,031,493

[45] June 21, 1977

[54] MINIATURE LOW PROFILE RELAY

[75] Inventor: Michael Principe Van Der Wielen, Reynoldsburg, Ohio

[73] Assignee: Bell Telephone Laboratories, Incorporated, Murray Hill, N.J.

[22] Filed: Dec. 12, 1975

[21] Appl. No.: 640,019

[52] U.S. Cl. ..... 335/128; 335/132

[51] Int. Cl.[2] ..... H01H 67/02

[58] Field of Search ..... 335/125, 128, 129, 132, 335/197, 276

[56] References Cited

UNITED STATES PATENTS

| | | | |
|---|---|---|---|
| 3,671,891 | 6/1972 | Shiojima et al. | 335/132 X |
| 3,911,383 | 10/1975 | Tabei et al. | 335/128 X |

*Primary Examiner*—George Harris
*Attorney, Agent, or Firm*—William H. Kamstra

[57] ABSTRACT

An electromechanical relay construction in which the electromagnetic actuator assembly and the contact spring subassembly are structurally and functionally distinct entities prior to final assembly. Specifically, the electromagnetic actuator assembly incorporates the armature return spring making possible independent testing of the actuator assembly for the actual force available for contact operation as compared to the current applied. Other features include an armature hinge stop for preventing excessive hinge spring displacement upon operation and rotatable coil terminals for facilitating soldering and providing wire protection and slack.

12 Claims, 4 Drawing Figures

MINIATURE LOW PROFILE RELAY

BACKGROUND OF THE INVENTION

This invention relates to electrical switch devices for selectively controlling the continuity of electrical circuits and more particularly to electromechanical relays for performing this function.

Over the years, electromechanical relays have found wide and varied application in the telephone and related arts and have assumed many structural forms. Basically, a relay of the character contemplated herein comprises an electromagnet, an armature, and a contact spring assembly, the armature being actuated to control the closing and/or opening of the contacts when the electromagnet is energized. Although in recent years solid state devices have replaced such relays in many communication systems, relays still offer many advantages in terms of cost, reliability, and versatility, for example, in circuit applications where the highest operative speed is not a requirement. Where the relays are operated in conjunction with electronic devices, the reduction in physical size of the latter components has also dictated a miniaturization of the relays and a number of miniature relay structure forms are also known in the art. When relays are to be used with printed circuit boards, for example, high packing density requires that the relay present a minimum profile and mounting area.

An important factor in the manufacture of any relay of whatever form an size, of course, is cost, especially when large numbers of the relays are to be produced. Any significant savings which may be realized in the assembly, inspection, and testing of a relay during its fabrication could thus be substantial in the aggregate. The inspection and testing phase of relay fabrication in particular has in the past added to the cost of manufacture in that a discovered defect frequently necessitated discarding an entire unit. Thus, if after final assembly, either the contact spring subassembly or the electromagnetic actuator subassembly proved defective, the entire relay might be rejected. Accordingly, in this particular area alone, costs could be halved, if the subassemblies were independently testable.

Accordingly, it is an object of this invention to make possible the independent testing of electromechanical relay subassemblies.

It is another object of this invention to minimize the profile and mounting area of an electromechanical relay without reducing its operating efficiency.

It is also an object of this invention to provide a new and improved electromechanical relay construction which is more readily assembled and disassembled than prior relay structures.

SUMMARY OF THE INVENTION

The foregoing and other objects of the invention are realized in one illustrative embodiment thereof comprising, in one aspect, a relay construction in which the electromagnetic actuator and the contact spring pile are fabricated as distinct and independent functional entities prior to final assembly. More specifically, the armature of the actuator assembly has its return spring constructed as an integral part thereof. As a result, the actuator assembly may be independently tested for the actual force available for contact spring operation compared to the test currents applied to the electromagnet. Similarly, the contact spring subassembly may be mechanically and electrically independently tested and screened before final assembly. Advantageously, if either subassembly should prove defective or unacceptable, it may be rejected and replaced without involving the other. A low profile is achieved by the novel magnetic actuator arrangement in which the armature is pivotally mounted across the upper surface of the open legs of a substantially U-shaped core, the coil being mounted about the base of the core. The contact spring subassembly is mounted across the under surfaces of the same core legs.

According to another aspect of the invention, an armature hinge arrangement is featured which minimizes the loading effect of the flex spring hinge. Specifically, an armature hingestop is provided which prevents displacement of the hinge spring during armature release by the normal force of the contact spring pile.

Another feature of a relay construction according to this invention is a novel coil terminal which is rotatably mounted in each of the coil bobbin end heads. In a first position a terminal end is rotated out from the bobbin to provide soldering access and then is rotated 90° to a final, more recessed position to provide wire slack and wire protection.

BRIEF DESCRIPTION OF THE DRAWING

The organization and operation of an electromechanical relay construction according to the principles of this invention together with the foregoing and other objects and features thereof will be better understood from a consideration of the detailed description of one illustrative embodiment which follows when taken in conjunction with the accompanying drawing in which.

DETAILED DESCRIPTION

Figure 1:
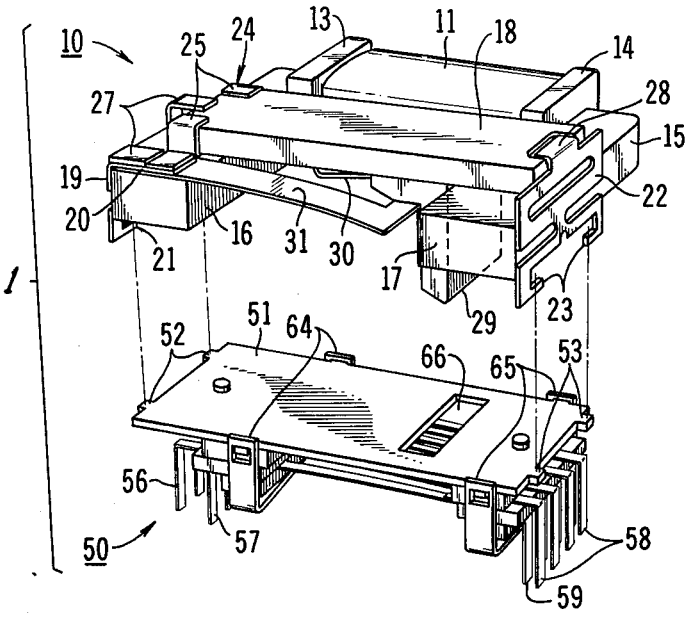
FIG. 1 depicts in three-quarter perspective and exploded view one specific illustrative two-section relay construction according to this invention.
Figure 2:
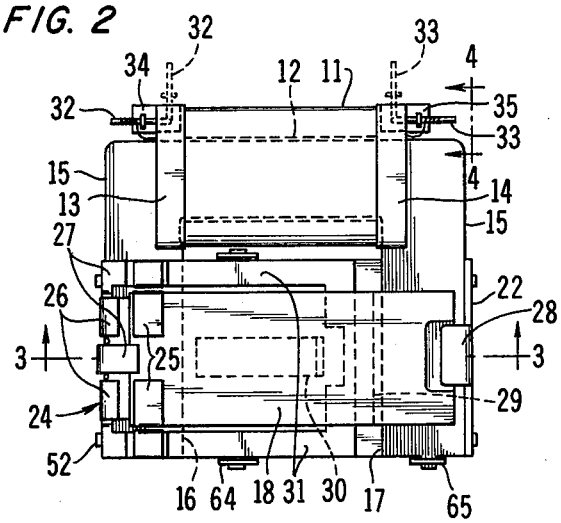
FIG. 2 is a plan top view of the relay construction of FIG. 1 as assembled.
Figure 4:
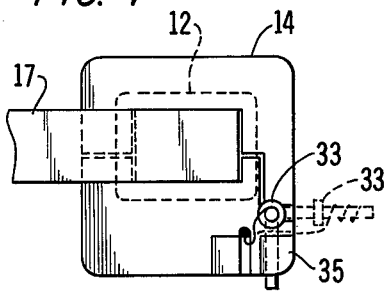
FIG. 4 is an end view of the coil assembly of the relay construction of the view of FIG. 2 as seen from the line 4—4.

Turning now to the drawing and particularly FIG. 1 thereof, an illustrative relay arrangement according to this invention is seen in exploded view as comprising an electromagnetic actuator subassembly 10 and a contact spring subassembly 50. The actuator subassembly comprises a coil 11 wound on a bobbin 12, only the end heads 13 and 14 of which are visible in that view. The bobbin 12, also shown in FIG. 2 and 4, is advantageously split along its longitudinal axis to present two halves to facilitate its fitting about the base of a U-shaped core 15 having forwardly extending legs 16 and 17 as viewed in the drawing. Other details of the coil 11 and bobbin 12 will be described hereinafter. A flat armature 18 is positioned transversely across the core legs 16 and 17 which have rectangular cross-sections. The armature 18 is pivotally mounted at one end on leg 16 of core 15 by means of a hinge assembly comprising an end clip 19 having a lug 20 at each end extending over the top of core leg 16, the clip 19 also having a portiond downwardly extending along the outer wall of leg 16 comprising a pair of spring clasps 21, only one of which is visible in FIG. 1. The general configuration of the clip 19 is more clearly seen from a similar clip 22 mounted on the side wall of leg 17 of core 15 which clip 22 also presents a pair of spring clasps 23. The function of the clips 19 and 23 will become apparent from the description of the contact spring subassembly 50 hereinafter. The armature hinge 24 itself is mounted directly on core leg 16 between clip lugs 20 and comprises a thin flat flexible spring having a pair of clasps 25 for enclosing and retaining the pivotal end of armature 18. Hinge 24 is also provided with an additional pair of clasps 26 for retaining a hinge plate and hinge stop 27, the relationship of which with the armature 18 is more clearly seen in the section view of FIG. 3. The hinge stop 27 is adapted to prevent any movement of the armature 18 at its pivotal end away from the core leg 16 due to flexion of the spring hinge 24.

Turning to the other end of armature 18, another clip 22, as already mentioned, is seen in FIG. 1 as being mounted on the outer wall of core leg 17. Clip 22 is additionally provided with an armature backstop 28 to limit the pivotal travel of armature 18, the backstop 28 riding in a recess provided therefore in the armature end. The core 15 and armature 18 are fabricated from a magnetic material suitable for completing a magnetic flux path as is known in the relay art, the stops 27 and 28 being formed of a nonmagnetic material. At the free end of armature 18 and downwardly extending therefrom as viewed in the drawing, is mounted a contact spring actuator card 29 by means of a retaining clip 30 more clearly shown in the section view of FIG. 3. The card 29 is formed of an electrically insulating material and also forms a bearing surface for an armature return spring 31, which spring 31 is advantageously fabricated as an integral part of the electromagnetic actuator subassembly.

The latter spring is substantially U-shaped, its legs being firmly maintained between the upper surface of core leg 16 and the lugs 20 of end clip 19, the legs also having clasps for enclosing the latter lugs. As shown particularly in the top plan view of FIG. 2, the legs of the return spring 31 lie outside of the profile of armature 18 and parallel with the outer edges thereof. The base of spring 31 passes transversely under armature 18 to ride, under spring tension, on surfaces provided on card 29 to maintain armature 18 in its normal position against backstop 28. The metallic elements of the actuator subassembly 10 thus far described may be welded in place or otherwise suitably affixed as indicated as most convenient during manufacture.

Figure 3:
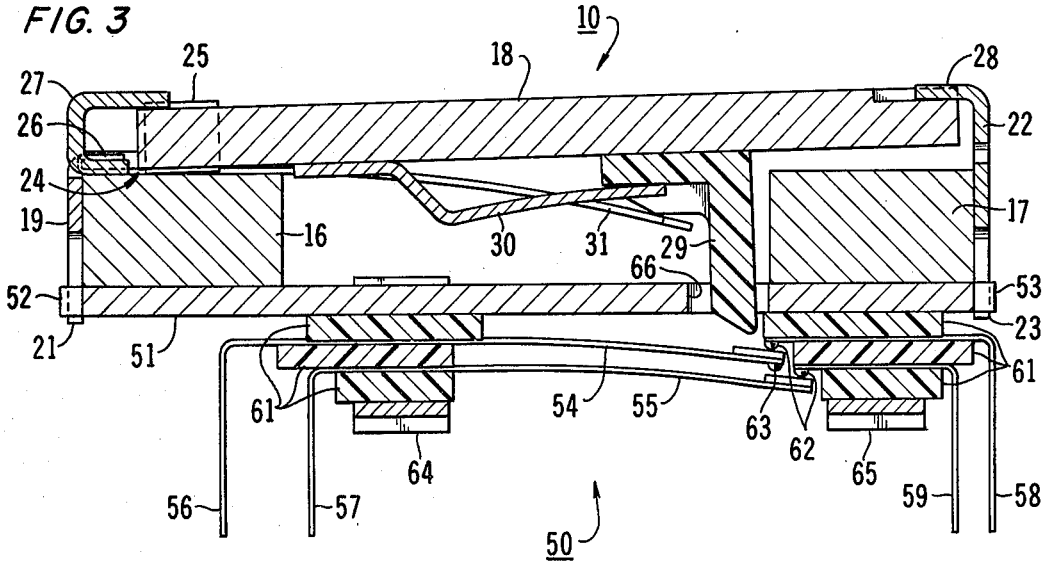
FIG. 3 is an enlarged section view of the relay construction of the view of FIG. 2 taken along the line 3—3.

The second section of an illustrative relay arrangement according to this invention is shown in FIG. 1 and 3 as comprising a contact spring subassembly 50 which in turn comprises a base mounting plate 51 and its contact spring piles. The mounting plate 51 is formed of a non-magnetic material and is provided at each end with a pair of lugs 52 and 53, which at final assembly, are adapted to be clasped by the spring clasps 21 and 23, respectively, of the clips 19 and 22 of actuator subassembly 10. Mounted on plate 51 is an exemplary plurality of contact spring pairs, one pair, springs 54 and 55, of which are shown in the section view of FIG. 3. The contact spring pairs terminate at one end in downwardly extending terminals 56–57. The individual springs of the spring pairs are separated by insulating spacers 61. As shown in FIG. 3, each of the springs of the spring pairs of the illustrative embodiment being described is normally closed with a back contact connected to a terminal 58 and 59 downwardly extending from the other end of the spring subassembly. Thus, the exemplary spring pair 54 and 55 is shown in FIG. 3 as being normally closed by means of break contacts 62 with terminals 58 and 59, respectively. A normally open make contact 63 on the back of each the upper springs is adapted to close a connection between the individual springs 54 and 55 of the spring pairs when the relay is energized. The individual terminals 58 and 59 are also suitably separated by insulating spacers 61. The spring pairs and terminals together with the insulating spacers are firmly maintained on mounting plate 51 by means of clamps 64 and 65 encircling the individual piles and engaging by means of suitably provided slots, lugs extending from each side of the plate 51 as more clearly seen in FIG. 1. A rectangular aperture 66 in mounting plate 51 in registration with the downwardly extending flange of actuator card 29 of subassembly 10 provides access for the latter flange to the contact spring piles as seen in FIG. 1 and in the sectional assembled view of FIG. 3.

An advantageous feature of a relay construction according to this invention is a novel coil terminal arrangement. As shown in FIG. 2, a pair of terminals 32 and 33 extend outwardly from the bobbin end heads 13 and 14 along an axis parallel to the longitudinal axis of the bobbin 12. Conventionally, the ends of the coil winding are soldered to these terminals and the terminals provide means for making electrical connections to external control circuitry. According to this invention, the terminals 32 and 33 comprise substantially L-shaped members one leg of each of which is staked in its respective bobbin head to be pivotal through at least 90° in a slot provided therefor in the bobbin head. Thus, as shown in FIG. 2, the terminals 32 and 33 are shown in their final positions and in positions indicated in dashed outline rotated 90° counterclockwise and clockwise, respectively. The terminal 33 is similarly shown in the end view of FIG. 4 in its position extending outwardly as viewed in the drawing and in a position extending perpendicularly from the bobbin axis. The latter positions for both terminals 32 and 33 are preassembly positions in which the terminals are more readily accessible for soldering the winding ends. After soldering has been completed the terminals are rotated to their final positions which conveniently slackens the winding wire ends to prevent subsequent strain and possible breakage after installation of the relay. Moreover, the final rotations of the terminals 32 and 33 moves the solder joints behind protective overhangs 34 and 35 formed on the end heads 13 and 14, respectively, and extending outwardly therefrom. Additional protection of the terminal connections is thus afforded to enhance relay reliability.

The operation of the relay of this invention after final assembly and installation is conventionally accomplished by the energization of coil 11 under the control of the circuit in which the terminals 32 and 33 may be connected in a system application. The resultant pivotal movement of armature 18 causes actuator card 29 to operate the contact spring pairs. As seen in FIG. 3 in connection with exemplary contact springs 54 and 55, contacts 62 are caused to open as a result and contact 63 closes a connection with spring 55. It will be appreciated that the operation of a single spring pair in the manner just described permits a number of options in circuit control merely by varying the circuit interconnections with the spring and contact terminals. It will also be understood that the contact spring organization shown in the drawing is illustrative only and that other spring arrangements known in the art may be mounted on plate 51 and operated by the single actuation of armature 18. In practice the relay arrangement according to this invention would be provided with suitable protective covers for both the actuator subassembly 10 and contact spring subassembly 50. These are not shown in the drawing and a detailed description of such enclosures is not considered necessary for a complete understanding of a relay construction according to this invention.

What has been described is considered to be only one specific illustrative relay embodiment according to this invention and it is to be further understood that various and numerous other arrangements may be devised by one skilled in the art without departing from the spirit and scope thereof as defined in the accompanying claims.

What is claimed is:

1. A low profile relay having a magnetic circuit subassembly and a distinct contact spring subassembly, said magnetic circuit subassembly comprising a substantially U-shaped core to present a base and a pair of legs, said core having a winding at said base, a flat armature member hinged at one end thereof to one surface of one of the legs of said core, an actuating insulated member mounted on said armature member adjacent the other leg of said core, and a flat return spring member held at one between said one leg of said core and said one end of said armature member and having its other end bearing against said actuating insulating member; said contact spring subassembly comprising a flat nonmagnetic support plate having a slot therein and a plurality of contact springs mounted on one side thereof, the other side of said support plate being affixed to the other surfaces of said legs of said core in a manner to permit said insulating member to extend through said slot.

2. A low profile relay construction comprising an electromagnetic actuator subassembly comprising a substantially U-shaped core member presenting a base and a pair of legs, said legs each having a first flat surface and a second opposite flat surface, a coil assembly fitted about said core member base, a flat armature member positioned across said core member legs on said first surfaces, a spring hinge for pivotally mounting one end of said armature member to one of said core member legs, a backstop for the other end of said armature member mounted on the other of said core member legs, an insulating actuator card mounted on said armature member and extending substantially perpendicularly therefrom in the direction of said second surfaces of said core member legs, and a flat return spring maintained at one end between said armature member at said one end thereof and said one of said core member legs, said spring at its other end urging said armature member against said backstop; and a contact spring subassembly comprising a flat nonmagnetic mounting plate adapted to have one side thereof removably mounted across said core member legs of said second surfaces, and a plurality of contact springs mounted on said plate on the other side thereof, said plate having a slot therein to permit access to said contact springs by said actuator card.

3. A low profile relay construction as claimed in claim 2 in which said return spring member comprises a substantially U-shaped member presenting a base and a pair of legs, said spring base operating transversely across said armature member and said spring legs extending to said one of said core member legs.

4. A low profile relay construction as claimed in claim 2 also comprising a hingestop for said one end of said armature member mounted on said one of said core member legs for limiting displacement of said spring hinge.

5. A low profile relay construction as claimed in claim 2, said coil assembly comprising a bobbin having a coil wound therearound and provided with a pair of end heads, each of said heads having an outwardly extending overhang, and a substantially L-shaped terminal member staked in each of said heads, said terminal members being in one position to facilitate forming solder joints with said coil and being rotatable in a second position to place said solder joints beneath said overhangs.

6. A low profile relay construction as claimed in claim 5 in which said bobbin is split along its longitudinal axis to present two halves enclosing said core member base.

7. An electromagnetic actuator mechanism for an electromechanical relay comprising a substantially U-shaped core member presenting a base and a pair of legs, said legs having a substantially rectangular cross-section, a coil assembly fitted about said core member base, a flat armature member positioned across one side of said core member legs, a flexible spring hinge for pivotally mounting one end of said armature member to one of said core member legs, a backstop for the other end of said armature member mounted on the other of said core member legs, an insulating contact spring actuator card mounted on said armature member, and a flat return spring maintained at one end at said one end of said armature member, said return spring at its other end urging said armature member in one direction against said backstop, said actuator card extending substantially perpendicularly from said armature member in a direction opposite to said one direction, the other sides of said core member legs being adapted to carry an electrical contact spring assembly thereacross.

8. An electromagnetic actuator mechanism as claimed in claim 7 in which said return spring comprises a substantially U-shaped member presenting a base and a pair of legs, said spring base operating transversely across said armature member and said spring legs extending outside the edges of said armature member to said one of said core member legs.

9. An electromgnetic actuator mechanism as claimed in claim 7 also comprising a hingestop for said one end of said armature member mounted on said one of said core member legs for limiting displacement of said flexible spring hinge.

10. An electromagnetic actuator mechanism as claimed in claim 7 in which said coil assembly comprises a bobbin having a coil wound therearound and provided with a pair of end heads, each of said heads having an overhang portion outwardly extending therefrom, and a substantially L-shaped terminal member staked in each of said heads, said terminal members being in one position to receive solder joints with said coil and being rotatable to a second position to place said solder joints beneath said overhang portions.

11. An electromagnetic actuator mechanism as claimed in claim 10 in which said bobbin is split along its longitudinal axis to present two halves enclosing said core member base.

12. A low profile relay construction comprising a substantially U-shaped core member presenting a base and a pair of parallelly extending legs, said legs having a substantially rectangular cross-section, energizing coil means fitted about said core member base, a flat armature positioned across a first surface of said core member legs, said armature being pivotally mounted at one end to one of said core member legs by means of a flexible spring hinge, a backstop for the other end of said armature mounted on the other of said core member legs, a return spring for urging said other end of said armature against said backstop comprising a substantially U-shaped member presenting a base and a pair of legs, said spring base operating transversely across said armature at said other end thereof and said spring legs being mounted at their ends on said first surface of said one of said core member legs, a non-magnetic support plate having an aperture therein and having an electrical contact spring assembly mounted thereon, said support plate being detachably mounted across said core member legs on second, opposite surfaces thereof, and an insulated actuator card mounted on said armature and extending substantially perpendicularly therefrom, said card being adapted to operate said contact spring assembly through said aperture in said support plate.

* * * * *